United States Patent [19]

Takahashi et al.

[11] 3,948,649

[45] Apr. 6, 1976

[54] FREE CUTTING STEEL

[75] Inventors: Tetsuo Takahashi, Nagoya; Minoru Yanagida, Ohfu, both of Japan

[73] Assignee: Daido Seiko Kabushiki Kaisha, Japan

[22] Filed: Mar. 1, 1974

[21] Appl. No.: 447,324

Related U.S. Application Data

[63] Continuation-in-part of Ser. No. 275,900, July 28, 1972, abandoned.

[30] Foreign Application Priority Data

Aug. 4, 1971 Japan ..... 46-58893

[52] U.S. Cl. ..... 75/128 P; 75/123 F; 75/123 N; 75/123 J; 75/126 B; 75/126 C; 75/126 G; 75/126 R; 75/128 W

[51] Int. Cl.[2] ..... C22C 38/60

[58] Field of Search ..... 75/123 N, 123 R, 123 F, 75/123 J, 123 G, 124, 126 G, 126 L, 126 M, 126 N, 126 R, 126 C, 128 P, 128 E

[56] References Cited

UNITED STATES PATENTS

| | | | |
|---|---|---|---|
| 2,236,479 | 3/1941 | Harder | 75/126 L |
| 2,914,400 | 11/1959 | Roberts | 75/123 F |
| 3,203,788 | 8/1965 | Contractor | 75/123 G |
| 3,630,723 | 12/1971 | Asada | 75/123 R |
| 3,634,074 | 1/1972 | Ito et al. | 75/126 M X |
| 3,729,293 | 4/1973 | Steven | 75/123 F |

OTHER PUBLICATIONS

"The Electron–Probe Microanalysis Oxide oxide Inclusions in Steel", Ridal et al., Journal of the Iron and Steel Inst., Oct. 1965, pp 995–997.

*Primary Examiner*—L. Dewayne Rutledge
*Assistant Examiner*—Arthur J. Steiner
*Attorney, Agent, or Firm*—Stevens, Davis, Miller & Mosher

[57] ABSTRACT

A free cutting steel for construction of machines, characterized in that the deoxidation product remaining in the steel has a composition of 40–60% of $SiO_2$, 10–30% of MnO and 5–25% of $Al_2O_3$, the balance being other oxides such as CaO and the sum of contents of $SiO_2$, MnO and $Al_2O_3$ being so adjusted as to be at least 85% of the whole oxides in the deoxidation products, the steel being further incorporated with 0.02 – 0.10% of Pb, and that the non-metallic composite inclusions comprising sulfides and finely divided Pb particles are uniformly dispersed.

14 Claims, 8 Drawing Figures

COMPOSITE INCLUSIONS COMPOSED OF OXIDES AND Pb

INCLUSIONS COMPOSED OF SULFIDES

50μ x 600

INCLUSIONS COMPOSED OF OXIDES

COMPOSITE INCLUSIONS COMPOSED OF SULFIDES AND Pb

50μ x 600

TEST PIECE : $8^{\phi} \times 16^{L}$

HEAT TREATMENT : (N) 890°C x 30min, O.Q
880°C x 60min, A.C
(SA) 760°C x 6 Hr, F.C TESTING MACHINE : $100^{t}$ AMSLER TESTING MACHINE

LUBRICATING OIL : MIXTURE OF MOLYBDENUM SULFIDE AND GREASE

NUMBER OF RUN : 15 TIMES A TEST PIECE

"H" IS MEASURED AT THE MOMENT WHEN A CRACK BEGINS TO OCCUR ON THE SURFACE

TEST PIECE : DIA 12mm x 22mm LENGTH

HEAT TREATMENT : INDUCTION QUENCHING
LOW-TEMPERATURE TEMPERING
HARDNESS: HRC63

TESTING MACHINE : ROLLING CONTACT FATIGUE LIFE TESTING MACHINE

NUMBER OF ROTATION : 46240 rpm

SURFACE PRESSURE : 600, 500, 400, kg/mm$^2$

LUBRICATING OIL : 140# TURBINE OIL (DROP)

FREE CUTTING STEEL

This application is a continuation-in-part application of application Ser. No. 275,900, filed July 28, 1972, now abandoned.

This invention relates to free cutting steels. More particularly, the invention relates to free cutting steels comprising metal components of steels referred to as carbon steel, manganese steel, manganese-chromium steel and alloy steel for the machine structural use in which the machinability has been improved by allowing the presence of suitable amounts of oxide inclusion of $SiO_2$-MnO-$Al_2O_3$ system and composite inclusions comprising sulfides and finely divided lead particles uniformly dispersed in the steel.

Various kinds of steels useful for manufacturing machine parts are well known. They include plain carbon steels and alloy steels. Recently, free cutting steels have been used broadly because it has been found that these steels can be cut at high speed with cemented carbide tools, and the tool life can be improved. However, in case free cutting steels of the Ca-type are cut with high speed steel tools, the improvement in the tool life is not prominent.

It is an object of the present invention to provide a free cutting steel which shows an improved tool life in cutting with tools, especially high speed steel tools.

It is another object of the present invention to provide a free cutting steel which possesses not only an excellent machinability but also good mechanical properties.

This invention will now be illustrated detailedly by reference to accompanying drawings.

Figure 1:
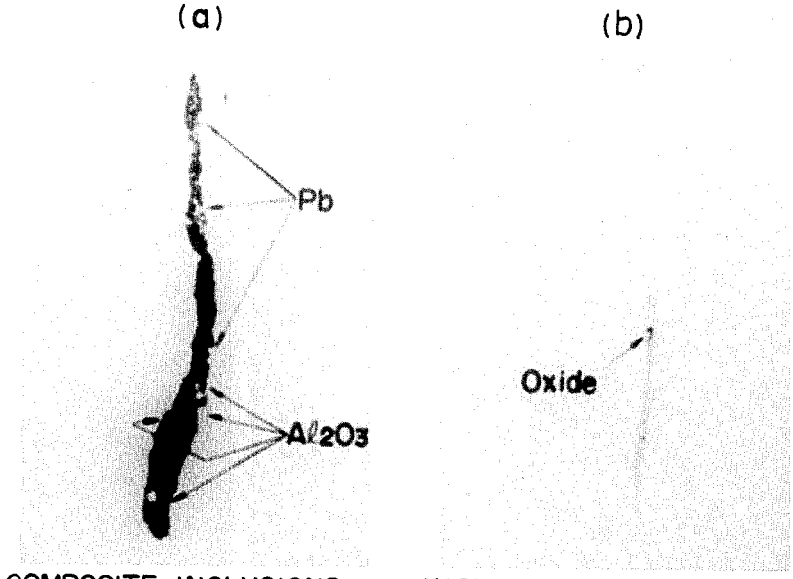
FIG. 1 is an enlarged photograph illustrating the state of non-metallic inclusions present in the conventional free cutting steel of the Ca-Pb type.

The inventors have made a many experiments on morphology of non-metallic inclusion in Ca-Pb type free cutting steel, and found that Pb forms composites of a large size with oxides and therefore, the dispersion of Pb in the steel is insufficient in such case. It was also found that the composition of oxide inclusions of almost all of these free cutting steels is approximately 40% $Al_2O_3$, 40% $SiO_2$ and 20% CaO. As a result of the investigation of the micro-structures of the Ca-Pb type free cutting steel containing a deoxidation product comprising such oxide inclusions as main ingredients, it was found that non-metallic inclusions consist mainly of composite inclusions formed from oxide inclusions and Pb particles, as shown in the photograph of FIG. 1-*a*, and inclusions composed solely of sulfide, as shown in the photograph of FIG. 1-*b*.

With a view to providing improved free cutting steels without above-mentioned defects, the inventors have done considerable research and found that satisfactory results can be obtained when composite inclusions composed of sulfides and finely divided lead particles are formed in the steel, and further, that the composite inclusions will be formed by reducing the melting point of the deoxidation product. Experiments for manufacturing the free cutting steel according the present invention were made for instance by the following procedures:

Molten steel was obtained by a conventional steel-making process in an electric arc furnace. Slag floating over the molten steel was removed and the oxygen content of the steel was adjusted to be in the range of 80 to 300 ppm. Then, the molten steel was tapped into a ladle and added with a low aluminum ferrosilicon deoxidizing alloy (composition: 18% Si, 0.1% Al, 0.01% C and the balance iron) in an amount of about 3 Kg/ton steel. At the tapping, lead was added to the molten steel stream at a rate of about 8 Kg/ton steel. As a result, deoxidation products floated up over the molten steel, and oxide inclusion of about 100 to 450 grams per ton steel remained as uniform dispersion in the steel with finely divided lead particles.

The composition of the oxide inclusion was: $SiO_4$ 40 to 60%, MnO 10–30%, $Al_2O_3$ 5 to 25% and MO up to 15%. The steel also contained the composite inclusions composed of sulfides and finely divided lead particles.

Figure 2:
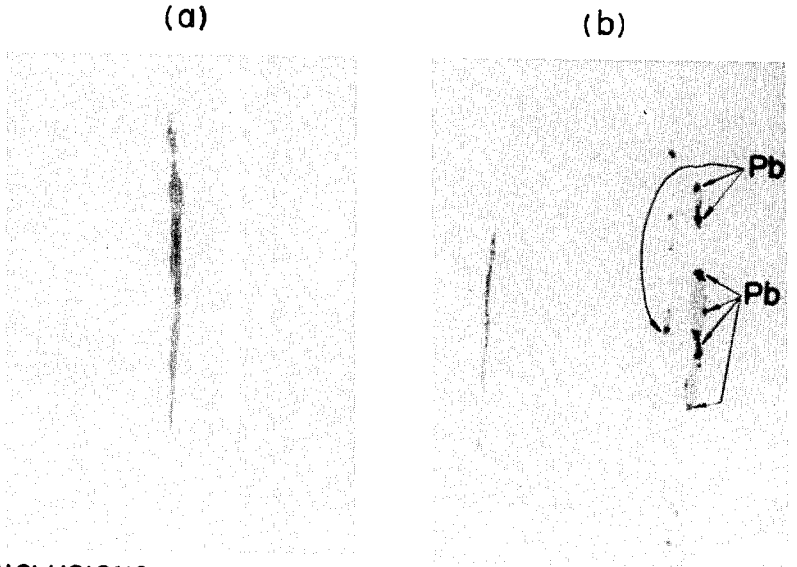
FIG. 2 is an enlarged photograph illustrating the state of non-metallic inclusions present in the free cutting steel of the present invention.

It has been confirmed that non-metallic inclusions of the so formed free cutting steel consists of inclusions comprised oxides as shown in FIG. 2-*a* and composite inclusions composed of sulfides divided Pb as shown in FIG. 2-*b*. It was also confirmed that the dispersion of such inclusions is very desirable one. Further, it was found that the cutting property of the free cutting steel in which the composite inclusions are uniformly dispersed, is extremely improved over the conventional free cutting steel of the Ca-Pb type, and the mechanical strength of such free cutting steel is quite comparable to that of the conventional free cutting steel of the Ca-Pb type.

Thus, in accordance with this invention, there is provided a free cutting steel for construction of machines, characterized in that the deoxidation product remains in the steel as an oxide inclusion in an amount within a range from 100 to 450 grams per ton of the steel and has a composition of 40–60% of $SiO_2$, 10–30% of MnO and 5–25% of $Al_2O_3$, the balance being other oxides such as CaO and the sum of contents of $SiO_2$, MnO and $Al_2O_3$ being so adjusted as to be at least 85% of the whole oxides in the deoxidation products, the steel being further incorporated with 0.02–0.10% of Pb, and that the non-metallic composite inclusions comprising sulfides and finely divided Pb particles are uniformly dispersed.

The components of the deoxidation product of the free cutting steel of the present invention will now be described. In order to obtain oxide inclusions which can readily be deformed by not working and can be elongated slenderly along the working and rolling direction, it is desirable to adjust the content of $SiO_2$ to at least 40%. However, in case $SiO_2$ is present together with 10–30% of MnO and 5–25% of $Al_2O_3$, the content of $SiO_2$ exceeding 60% is not preferred for purpose of reduction of the melting point of the deoxidation product. In order to maintain lower the melting point of the deoxidation product, it is preferred that MnO is present in a content of at least 10%. However, in atmospheric melting and smelting, the MnO content which is present together with 40–60% of $SiO_2$ and 5–25% of $Al_2O_3$, is quite difficult to increase above 30%. Therefore, the MnO content is adjusted within the range of 10 to 30 %. In order to obtain a deoxidation product having lower melting point, it is preferred that the content of $Al_2O_3$ is lower. However, in atmospheric melting and smelting, it is difficult to reduce the $Al_2O_3$ content below 5%, if $Al_2O_3$ is present together with 40–60% of $SiO_2$ and 10–30% of MnO. Too high content of $Al_2O_3$ results in increase of the softening and melting point of the deoxidation product. Therefore, it is not preferred to increase the content of the $Al_2O_3$ above 25%.

It is usually inevitable that other oxides such as CaO, FeO and MgO are incorporated in the deoxidation product. It is desirable to adjust the content of such oxide impurities to a level not interferring with the above object, that is, within a range of up to 15%. It has been found that in order to reduce the melting point of the deoxidation product composed of $SiO_2$, MnO, $Al_2O_3$ and other oxides such as CaO, the sum of the contents of $SiO_2$, MnO and $Al_2O_3$ must be preferably at least 85% as a result of experiments.

It is necessary to adjust the content of the oxide inclusion to fall within a range from 100 to 450 grams per ton of the steel in order to obtain a desirable uniform distribution of the finely divided lead particles and sulfides in the steel.

The present invention is applicable to most carbon steels, manganese steels and manganese-chromium steel for machine structural use and other structural alloy steels; i.e., steels of many grades can be employed for preparing the free-cutting steel of the present invention. Representatives of such steels and their composition ranges are shown in Table 1.

Table 1

| Steel Mark | Composition (%) C | Si | Mn | Ni | Cr | Mo |
|---|---|---|---|---|---|---|
| Carbon Steel | | | | | | |
| SAE 1010–1055 | 0.08 ' 0.60 | 0.10 ' 0.30 | 0.30 ' 1.65 | — | — | — |

Table 1-continued

| Steel Mark | Composition (%) C | Si | Mn | Ni | Cr | Mo |
|---|---|---|---|---|---|---|
| JIS G 4051 | 0.08 ' 0.61 | 0.15 ' 0.35 | 0.30 ' 0.90 | — | — | — |
| S48C, S45C | 0.40 ' 0.55 | 0.15 ' 0.35 | 0.60 ' 1.00 | — | — | — |
| SAE 143,1045, 1046,1049,1050 | | | | | | |
| Chromium Steel | | | | | | |
| SAE 5015,5040,5060 5115–5160 | 0.12 ' 0.64 | 0.20 ' 0.35 | 0.30 ' 1.00 | — | 0.30 ' 1.15 | — |
| JIS G 4104 | 0.13 ' 0.48 | 0.15 ' 0.35 | 0.60 ' 0.85 | — | 0.90 | — |
| SCr 2–5,21,22 | | | | | | |
| Chromium-Molybdenum Steel | | | | | | |
| JIS G4105 | 0.18 ' 0.65 | 0.15 ' 0.35 | 0.30 ' 1.00 | — | 0.70 ' 1.20 | 0.15 ' 0.35 |
| SCM 1–5,21–24 SAE 4118–4161 | | | | | | |
| JIS G 4105 | 0.18 ' 0.23 | 0.15 ' 0.35 | 0.60 ' 0.85 | | 0.90 ' 1.20 | 0.15 ' 0.30 |
| SCM 22 | | | | | | |
| Manganese Steel | | | | | | |
| JIS G 4106 | 0.17 ' 0.48 | 0.15 ' 0.35 | 1.20 ' 1.90 | — | — | — |
| SAE 1330–1345 SMN 1–3,21 | | | | | | |
| Molybdenum Steel | | | | | | |
| SAE 4012–4047, 4419–4427 | 0.09 ' 0.50 | 0.20 ' 0.35 | 0.65 ' 1.00 | — | — | 0.15 ' 0.60 |
| Manganese-Chromium Steel | | | | | | |
| JIS G4106 | 0.17 ' 0.46 | 0.15 ' 0.35 | 1.20 ' 1.65 | — | 0.35 ' 0.70 | — |
| SMN C3,21 | | | | | | |
| Nickel-Chromium Steel | | | | | | |
| JIS G4102 | 0.12 ' 0.40 | 0.15 ' 0.35 | 0.35 ' 0.80 | 1.00 ' 3.50 | 0.20 ' 1.00 | — |
| SNC 1–3,21,22 | | | | | | |
| Nickel-Chromium-Molybdenum Steel | | | | | | |
| SAE 4320,4340 4718,4720,8115 | 0.08 ' 0.64 | 0.20 ' 0.35 | 0.45 ' 1.00 | 0.40 ' 3.50 | 0.30 ' 1.40 | 0.08 ' 0.40 |
| 8615–8660,8720, 8740 8822,9260,9310 | | | | | | |
| JIS G4103 SNCM 1–9,21–26 | 0.12 ' 0.50 | 0.15 ' 0.35 | 0.35 ' 1.20 | 0.40 ' 4.50 | 1.40 ' 3.50 | 0.15 ' 0.70 |

*The balance is iron and inherent impurities.

This invention will now be more illustrated in detail by reference to Examples.

EXAMPLE 1

Steels containing deoxidation producrs of the composition indicated in Table 2 were prepared, and the tool life was determined with respect to each of these steels. Results are shown in Table 3.

Table 2

| No. | Samples | Steel Mark | Chemical Composition (%) C | Si | Mn | P | S | Cr | Mo | Pb | Ca |
|---|---|---|---|---|---|---|---|---|---|---|---|
| a-1 | Conventional steel | SCM 22-C1 | 0.20 | 0.27 | 0.65 | 0.015 | 0.020 | 1.01 | 0.18 | 0.18 | 0.003 |
| a-2 | Conventional Steel | SCM 22-C2 | 0.21 | 0.29 | 0.67 | 0.018 | 0.021 | 1.00 | 0.19 | 0.19 | 0.004 |
| A-1 | Steel of This Invention | SCM 22-A1 | 0.21 | 0.24 | 0.69 | 0.016 | 0.036 | 1.01 | 0.19 | 0.06 | — |
| A-2 | Steel of This Invention | SCM 22-A2 | 0.21 | 0.25 | 0.72 | 0.015 | 0.016 | 1.03 | 0.16 | 0.10 | — |
| A-3 | Steel of This Invention | SCM 22-A3 | 0.18 | 0.24 | 0.69 | 0.019 | 0.016 | 1.03 | 0.20 | 0.02 | — |
| a-3 | Conventional Steel | S45C-C | 0.44 | 0.25 | 0.76 | 0.016 | 0.017 | — | — | 0.16 | 0.002 |
| A-4 | Steel of This Invention | S45C-A | 0.45 | 0.24 | 0.69 | 0.015 | 0.018 | — | — | 0.08 | — |

| No. | Samples | Composition of Deoxidation Product (%) $SiO_2$ | MnO | $Al_2O_3$ | others | $(SiO_2+MnO+Al_2O_3)$ | $\frac{(SiO_2+MnO)}{(Al_2O_3)}$ | Melting Point (°C.) Synthetic Slag having same composition as deoxidation product[1)] |
|---|---|---|---|---|---|---|---|---|
| a-1 | Conventional Steel | 28 | 5 | 39 | 1 | 72 | 0.85 | 1,450 |
| a-2 | Conventional Steel | 30 | 5 | 45 | 1 | 80 | 0.78 | 1,470 |

Table 2-continued

| No. | Samples | Composition of Deoxidation Product (%) $SiO_2$ | MnO | $Al_2O_3$ | others | $(SiO_2+MnO+Al_2O_3)$ | $\frac{(SiO_2+MnO)}{(Al_2O_3)}$ | Melting Point (°C.) Synthetic Slag having same composition as deoxidation product[1)] |
|---|---|---|---|---|---|---|---|---|
| A-1 | Steel of This Invention | 43 | 22 | 21 | 2 | 86 | 3.1 | 1,270 |
| A-2 | Steel of This Invention | 51 | 25 | 17 | 2 | 93 | 4.5 | 1,210 |
| A-3 | Steel of This Invention | 46 | 27 | 18 | 1 | 91 | 4.1 | 1,230 |
| a-3 | Conventional Steel | 36 | trace | 42 | 1 | 99 | 0.9 | 1,520 |
| A-4 | Steel of This Invention | 45 | 16 | 25 | 1 | 86 | 2.4 | 1,360 |

[1)]the melting point was determined by means of Seger Cone.

Table 3

| No. | Samples | Life of high speed steel tool (V=80m/min) | Tensile strength (kg/mm²) | 0.2% proof stress (kg/mm²) | Elongation (%) | Reduction of area (%) | Charpy impact value (kg.m/cm²) | Heat Treatment |
|---|---|---|---|---|---|---|---|---|
| a-1 | Conventional Steel | 75 | 98.5 | 70.0 | 20.5 | 58.3 | 12.5 | |
| a-2 | Conventional Steel | 82 | 100.3 | 68.9 | 20.3 | 57.9 | 12.3 | 870°C×30minutes and oil quenching; |
| A-1 | Steel of this Invention | 220 | 110.3 | 71.3 | 20.8 | 58.5 | 13.4 | 830°C×30minutes and oil quenching; |
| A-2 | Steel of this Invention | 250 | 105.2 | 73.1 | 19.5 | 58.4 | 12.7 | 200°C×60minutes and water tempering |
| A-3 | Steel of this Invention | 240 | 99.8 | 70.5 | 19.7 | 58.5 | 12.4 | |
| a-3 | Conventional Steel | 20 | 125.3 | 80.3 | 18.5 | 50.1 | 7.5 | 840°C and air cooling |
| A-4 | Steel of this Invention | 35 | 124.1 | 79.8 | 18.0 | 51.0 | 8.0 | 835°C and water quenching 600°C and oil tempering |

Figure 3:
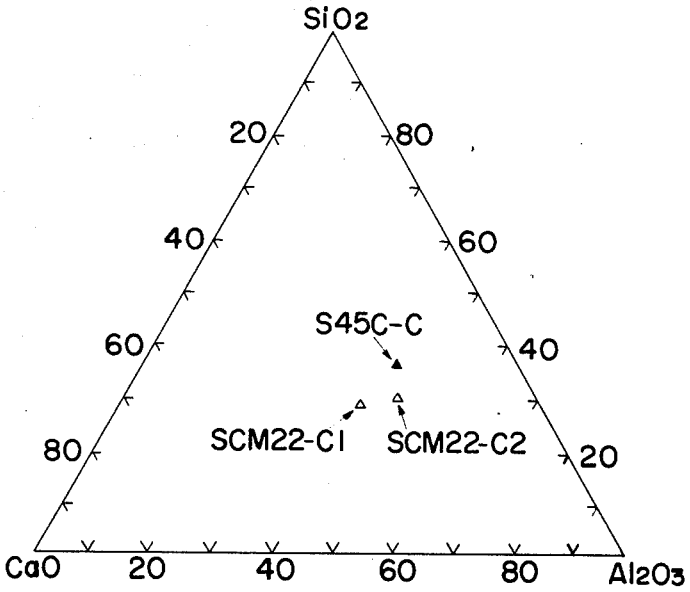
FIG. 3 is a triangular coordinate of the phase diagram for the system $SiO_2$-CaO-$Al_2O_3$, of the deoxidation product in the conventional free cutting steel of the Ca-Pb type.
Figure 4:
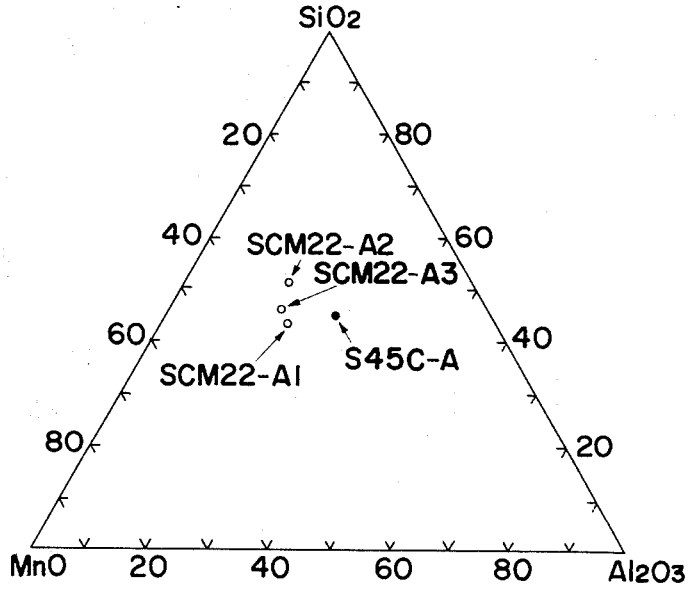
FIG. 4 is a triangular coordinate of the phase diagram for system $SiO_2$-MnO-$Al_2O_3$, of the deoxidation product in the free cutting steel of the present invention.

We show the phase diagram for the system of $SiO_2$–CaO-$Al_2O_3$ of the deoxidation product of conventional free cutting steels of the Ca-Pb type in FIG. 3. From the FIG. 3 and the Table 2, it is observed that the melting points of the deoxidation product of the above conventional free cutting steels are above 1,450°C. According to the steel of the present invention, the composition of the oxide inclusions is maintained within the above-mentioned specific range, and the relation of these three oxides are shown in the phase diagram for the system of $SiO_2$-MnO-$Al_2O_3$ of FIG. 4, and it was found that the melting point of the deoxidation product is below 1,350°C.

Namely, the steel of the present invention shows an extremely improved tool life as shown in Table 3 on account of reduction of the melting point of the deoxidation product and uniform distribution of finely divided Pb particles and sulfides in the form of non-metallic inclusions such as illustrated in FIG. 2.

Further, it was also found that, as shown in Table 3, the steel of this invention is a free cutting steel of high quality of which the mechanical properties are superior or comparable to the conventional free cutting steel of the Ca-Pb type.

Figure 5:
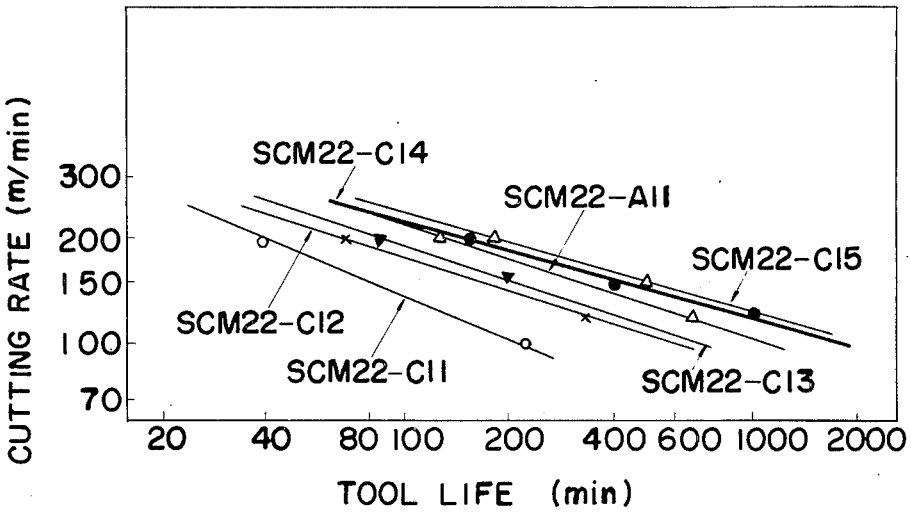
FIGS. 5 and 6 are graphs illustrating the life of a cemented carbide tool at the high speed cutting test of SCM 22-type steel and S48C-type steel.
Figure 6:
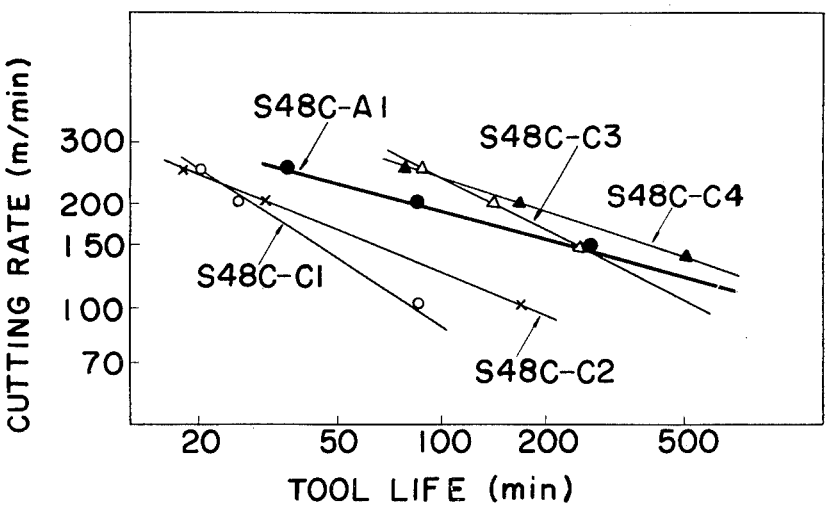

We prepared steels having compositions shown in Table 4, and test specimens thereof were subjected to the high speed cutting test under the turning conditions indicated in Table 5. Results are shown in FIGS. 5 and 6. Namely, it was confirmed that the improvement in the tool life attained by the steel of the present invention is superior or comparable to that attained in the conventional free cutting steels of the Ca-Pb-S type. Thus according to the steels of this invention, the tool life at low speed cutting by a high speed steel tool (SKH 4) (see Table 3) and at high speed cutting by a cemented carbide tool has been extremely improved. As is shown in Table 6, further, the cutting scrap obtained by cutting of the steel of the present invention with high speed steel tool could be very easily crushed during cutting.

Table 4

| No. | Samples | Steel Mark | Chemical Composition, % C | Si | Mn | P | S | Ni | Cr | Mo | Pb | Ca |
|---|---|---|---|---|---|---|---|---|---|---|---|---|
| b-1 | | SCM22-C11 | 0.21 | 0.20 | 0.77 | 0.010 | 0.020 | | 1.12 | 0.18 | — | — |
| b-2 | Conventional | SCM22-C12 | 0.21 | 0.26 | 0.75 | 0.012 | 0.020 | — | 1.10 | 0.18 | 0.18 | — |
| b-3 | steels | SCM22-C13 | 0.20 | 0.25 | 0.75 | 0.015 | 0.015 | Nb 0.04 | 0.99 | 0.18 | — | 0.002 |
| b-4 | | SCM22-C14 | 0.21 | 0.27 | 0.73 | 0.013 | 0.055 | Nb 0.05 | 1.09 | 0.19 | — | 0.003 |
| b-5 | | SCM22-C15 | 0.21 | 0.29 | 0.72 | 0.016 0.048 | Nb 0.05 | 1.04 | 0.20 | 0.14 | 0.001 | |
| B-1 | Steel of this invention | SCM22-A11 | 0.20 | 0.26 | 0.75 | 0.015 | 0.040 | Nb 0.03 | 1.00 | 0.20 | 0.06 | — |
| b-6 | | S48C-C1 | 0.47 | 0.26 | 0.74 | 0.017 | 0.025 | — | — | — | — | — |
| b-7 | Conventional | S48C-C2 | 0.52 | 0.26 | 0.72 | 0.015 | 0.020 | — | — | — | 0.17 | — |
| b-8 | Steels | S48C-C3 | 0.47 | 0.27 | 0.76 | 0.014 | 0.015 | — | — | — | — | 0.002 |
| b-9 | | S48C-C4 | 0.49 | 0.29 | 0.75 | 0.016 | 0.062 | — | — | — | 0.22 | 0.001 |
| B-2 | Steel of this invention | S48C-A1 | 0.46 | 0.31 | 0.72 | 0.016 | 0.028 | — | — | — | 0.06 | — |

Table 4-continued

| No. | Samples | Steel Mark | Chemical Composition, % C | Si | Mn | P | S | Ni | Cr | Mo | Pb | Ca |
|---|---|---|---|---|---|---|---|---|---|---|---|---|

| No. | Deoxidation Product (g/ton steel) | Composition of deoxidation product, % $SiO_2$ | MnO | $Al_2O_3$ | others | $(SiO_2)+(MnO)+(Al_2O_3)$ (%) |
|---|---|---|---|---|---|---|
| b-1 | 135 | 4 | — | 95 | 1 | 99 |
| b-2 | 130 | 3 | — | 93 | 4 | 96 |
| b-3 | 215 | 33 | 8 | 39 | 20 | 80 |
| b-4 | 233 | 22 | 6 | 54 | 18 | 82 |
| b-5 | 218 | 28 | 10 | 41 | 21 | 79 |
| B-1 | 225 | 48 | 25 | 19 | 8 | 92 |
| b-6 | 85 | 2 | — | 97 | 1 | 99 |
| b-7 | 76 | 2 | — | 95 | 3 | 97 |
| b-8 | 124 | 26 | 1 | 35 | 38 | 62 |
| b-9 | 121 | 30 | 7 | 45 | 18 | 82 |
| B-2 | 138 | 46 | 17 | 25 | 12 | 88 |

Table 5

| | |
|---|---|
| Cutting Tool | P10 (cemented carbide tool consisting of 63% of WC, 38% of (TiC = TaC) and 9% of Co) |
| Tool Form | −5, −5, 5, 5, 30, 0, 0, 0.4 |
| Cutting Speed | 0.20 mm/rev. |
| Tool Life | $V_B$ = 0.3 mm (determined based on the time required for flank abrasion of the tool to reach 0.3 mm) |
| Heat Treatment of Steels | normalizing at 900°C for 2 hours and air cooling (steel of SCM 22-type), or normalizing at 850°C for 2 hours and air cooling (steel of S48C-type) |
| Hardness | HRB = 165–170 (steel of SCM 22-type), or HRB = 201–210 (steel of S48C-type) |
| Cutting Oil | None |

Table 6

| No. | Breakability of Cutting Chip Steels | Breakability |
|---|---|---|
| b-1 | SCM22-C11 | X |
| b-2 | SCM22-C12 | 0 |
| b-3 | SCM22-C13 | X |
| b-4 | SCM22-C14 | Δ |
| b-5 | SCM22-C15 | 0 |
| B-1 | SCM22-A11 | 0 |
| b-6 | S48C-C1 | X |
| b-7 | S48C-C2 | 0 |
| b-8 | S48C-C3 | X |
| b-9 | S48C-C4 | 0 |
| B-2 | S48C-A1 | 0 |

Remarks:

(1) Cutting Conditions

| | |
|---|---|
| Tool | SKH4 0, α, 7, 7, 10, 0, 0 (α = 0°, 8°, 16°) |
| Cutting speed | 40, 60, 80 m/min. |

Table 6-continued

| No. | Breakability of Cutting Chip Steels | Breakability |
|---|---|---|
| | Feed | 0.05, 0.10, 0.15 mm/rev. |
| | Depth of Cut | 0.15, 0.30, 0.45, 0.60, 0.90, 1.20, 180 mm. |
| | Repeated 27 tims | |
| (2) | Evaluation: X : no good | Δ : fairly good 0 : good. |

Figure 7:
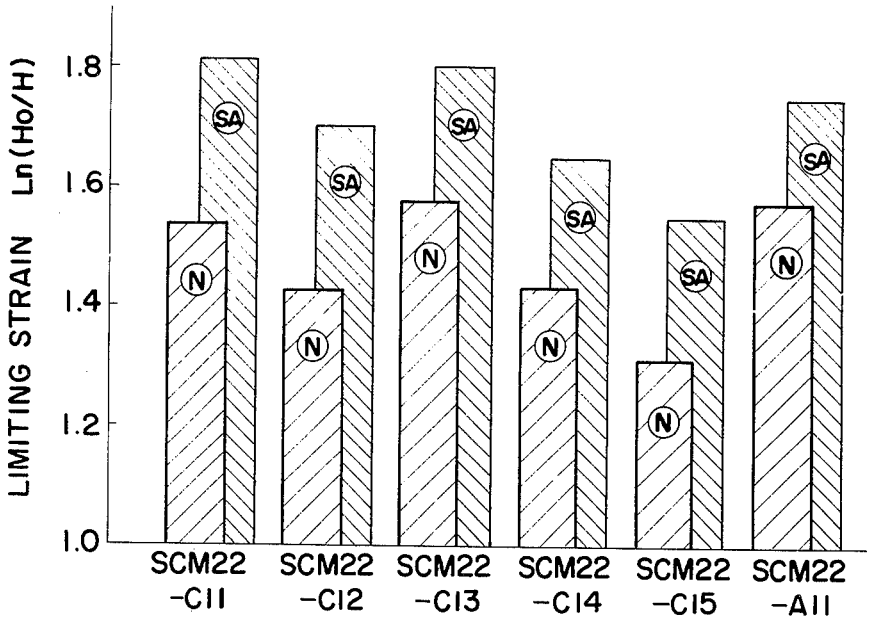
FIG. 7 is a view illustrating the critical strain in cold formability test of SCM 22-type steel.
Figure 7:
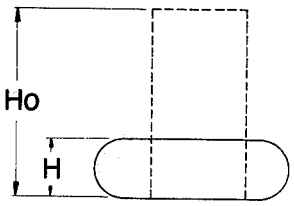

In order to examine the cold workability of the SCM 22-type steels of the present invention, the critical strain of test specimens (diameter = 8 mm; length = 16 mm) as normalized (Ⓝ) and as spheroidizing annealed (SA) were determined under the upset condition. As the results shown in FIG. 7, it was confirmed that the workability of the steel according to the present invention in cold working is almost to that of the conventional steels (SCM 22-C11 or SCM 22-C13).

Figure 8:
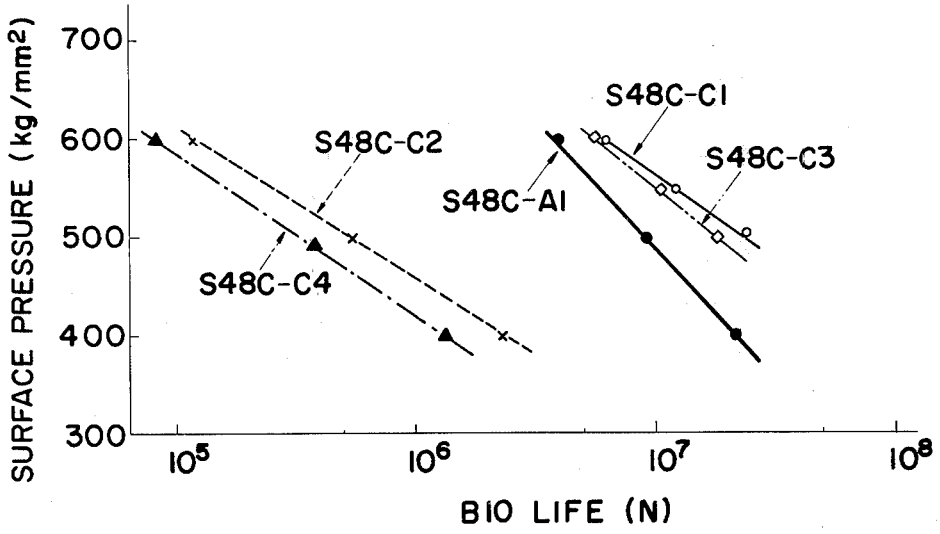
FIG. 8 is a graph illustrating rolling contact fatigue life of S48C-type steel.

FIG. 8 illustrates results of determination of the rolling contact fatigue life of the S48C-type steel of the present invention, which had been heat-treated so that the steel had a Rockwell hardness C of 63. From the FIG. 8, it is seen that the rolling contact fatigue life of the steel of this invention is not substantially different from that of the basic steel (S48C1).

EXAMPLE 2

Steels of the composition indicated in Table 7 were prepared.

The steel specimens were tempered and subjected to cutting test under the conditions indicated in Table 8.

The results as high speed steel tool life for each specimens are shown in Table 9.

Table 7

| No. | Samples | Chemical Composition (%) C | Si | Mn | Pb | Ca | Deoxidation Product (g/ton steel) | Composition of Deoxidation Product (%) $SiO_2$ | MnO | $Al_2O_3$ | Others | $(SiO_2)+(MnO)+(Al_2O_3)$ (%) |
|---|---|---|---|---|---|---|---|---|---|---|---|---|
| C-1 | Steel of this Invention | 0.08 | 0.15 | 0.50 | 0.05 | — | 450 | 51 | 25 | 9 | 15 | 85 |
| C-2 | | 0.20 | 0.11 | 0.35 | 0.02 | — | 328 | 57 | 22 | 10 | 11 | 89 |
| C-3 | | 0.31 | 0.21 | 1.45 | 0.08 | — | 253 | 50 | 17 | 21 | 12 | 88 |
| C-4 | | 0.40 | 0.25 | 1.62 | 0.06 | — | 170 | 43 | 13 | 24 | 15 | 85 |
| C-5 | | 0.50 | 0.35 | 0.90 | 0.04 | — | 125 | 49 | 12 | 24 | 15 | 85 |
| C-6 | | 0.61 | 0.30 | 0.79 | 0.07 | — | 103 | 50 | 10 | 25 | 11 | 85 |
| c-1 | | 0.09 | 0.14 | 0.48 | — | 0.003 | 403 | 60 | 1 | 21 | 18 | 82 |
| c-2 | | 0.19 | 0.12 | 0.35 | — | 0.002 | 307 | 48 | 0 | 39 | 13 | 87 |

Table 7-continued

| No. | Samples | Chemical Composition (%) C | Si | Mn | Pb | Ca | Deoxidation Product (g/ton steel) | Composition of Deoxidation Product (%) $SiO_2$ | MnO | $Al_2O_3$ | Others | $(SiO_2)+(MnO)+(Al_2O_3)$ (%) |
|---|---|---|---|---|---|---|---|---|---|---|---|---|
| c-3 | Conventional Steels | 0.30 | 0.22 | 1.42 | — | 0.001 | 215 | 26 | 1 | 55 | 18 | 82 |
| c-4 | | 0.42 | 0.23 | 1.65 | — | 0.003 | 125 | 31 | 0 | 59 | 10 | 90 |
| c-5 | | 0.49 | 0.34 | 0.87 | — | 0.002 | 115 | 23 | 0 | 68 | 14 | 86 |
| c-6 | | 0.58 | 0.28 | 0.82 | — | 0.004 | 92 | 21 | 0 | 63 | 16 | 84 |

Table 8

| | |
|---|---|
| Cutting Conditions | |
| Tool | SKH 57 (0, 15, 7, 7, 10, 0, 0.5) |
| Feed | 0.12 mm/rev. |
| Cutting Speed | 80 m/min |
| Depth of Cut | 1 mm |
| Cutting Oil | Water insoluble |
| Tool life is determined by melting thereof. | |

Table 9

| No. | Samples | Tool Life of High Speed Steel Tool (min) |
|---|---|---|
| C-1 | Steel of this Invention | 950 |
| C-2 | | 420 |
| C-3 | | 85 |
| C-4 | | 33 |
| C-5 | | 30 |
| C-6 | | 12 |
| c-1 | Conventional Steels | 480 |
| c-2 | | 230 |
| c-3 | | 35 |
| c-4 | | 15 |
| c-5 | | 20 |
| c-6 | | 7 |

EXAMPLE 3

Steels having the compositions indicated in Table 10 were prepared.

The tempered steel specimens were subjected to cutting test under the conditions indicated also in Table 8.

Table 11 shows the high speed steel tool life.

Table 11

| No. | Samples | Tool Life of High Speed Steel Tool (min) |
|---|---|---|
| D-1 | Steel of this Invention | 280 |
| D-2 | | 130 |
| D-3 | | 68 |
| D-4 | | 41 |
| D-5 | | 18 |
| d-1 | Conventional Steels | 150 |
| d-2 | | 65 |
| d-3 | | 30 |
| d-4 | | 17 |
| d-5 | | 8 |

Table 10

| No. | Samples | Chemical Composition (%) C | Si | Mn | Cr | Pb | Ca | Deoxidation Product (g/ton Steel) | Composition of Deoxidation Products (%) $SiO_2$ | MnO | $Al_2O_3$ | Others | $(SiO_2)+(MnO)+(Al_2O_3)$ (%) |
|---|---|---|---|---|---|---|---|---|---|---|---|---|---|
| D-1 | Steel of this Invention | 0.12 | 0.28 | 0.45 | 0.31 | 0.03 | — | 353 | 60 | 23 | 5 | 12 | 88 |
| D-2 | | 0.21 | 0.25 | 0.80 | 0.90 | 0.05 | — | 362 | 58 | 20 | 14 | 8 | 92 |
| D-3 | | 0.35 | 0.15 | 0.73 | 1.05 | 0.07 | — | 225 | 48 | 17 | 23 | 12 | 88 |
| D-4 | | 0.48 | 0.34 | 0.83 | 1.13 | 0.09 | — | 133 | 50 | 10 | 25 | 15 | 85 |
| D-5 | | 0.64 | 0.28 | 0.98 | 0.82 | 0.08 | — | 100 | 48 | 12 | 25 | 15 | 85 |
| d-1 | Conventional Steels | 0.11 | 0.24 | 0.43 | 0.31 | — | 0.001 | 348 | 53 | 2 | 24 | 21 | 79 |
| d-2 | | 0.20 | 0.23 | 0.77 | 0.91 | — | 0.001 | 311 | 50 | 0 | 31 | 19 | 81 |
| d-3 | | 0.35 | 0.17 | 0.71 | 1.02 | — | 0.002 | 230 | 54 | 1 | 29 | 17 | 83 |
| d-4 | | 0.49 | 0.31 | 0.80 | 1.15 | — | 0.003 | 123 | 48 | 0 | 39 | 13 | 87 |
| d-5 | | 0.63 | 0.28 | 0.97 | 0.79 | — | 0.005 | 89 | 46 | 0 | 42 | 12 | 88 |

EXAMPLE 4

Chromium-Molybdenum steels of the compositions given in Table 13 were prepared.

The tempered steel specimens were subjected to cutting test under the conditions indicated also in Table 8. The determined high speed steel tool life is shown in Table 13.

Table 13

| No. | Samples | Tool Life of High Speed Steel Tool (min) |
|---|---|---|
| E-1 | Steel of this Invention | 210 |
| E-2 | | 68 |
| E-3 | | 29 |
| E-4 | | 11 |
| e-1 | Conventional Steel | 105 |
| e-2 | | 25 |
| e-3 | | 12 |

Table 13-continued

| No. | Samples | Tool Life of High Speed Steel Tool (min) |
|---|---|---|
| e-4 | | 4 |

Table 15-continued

| No. | Samples | Tool Life of High Speed Steel Tool (min) |
|---|---|---|
| | Steels | |
| f-3 | | 15 |

Table 13

| No. | Sample | Chemical Composition (%) | | | | | | | Deoxidation Product (g/ton Steel) | Composition of Deoxidation Products (%) | | | | $(SiO_2)+(MnO)+(Al_2O_3)$ (%) |
|---|---|---|---|---|---|---|---|---|---|---|---|---|---|---|
| | | C | Si | Mn | Cr | Mo | Pb | Ca | | $SiO_2$ | MnO | $Al_2O_3$ | others | |
| E-1 | Steel of this Invention | 0.18 | 0.34 | 0.80 | 0.51 | 0.13 | 0.04 | — | 348 | 53 | 28 | 7 | 12 | 88 |
| E-2 | | 0.35 | 0.25 | 0.81 | 1.02 | 0.20 | 0.07 | — | 218 | 49 | 17 | 20 | 14 | 86 |
| E-3 | | 0.45 | 0.25 | 0.95 | 1.05 | 0.23 | 0.08 | — | 163 | 52 | 11 | 23 | 14 | 86 |
| E-4 | | 0.65 | 0.28 | 0.75 | 0.73 | 0.32 | 0.05 | — | 105 | 52 | 10 | 25 | 13 | 87 |
| e-1 | Conventional Steels | 0.18 | 0.33 | 0.79 | 0.53 | 0.15 | — | 0.002 | 333 | 62 | 0 | 20 | 18 | 82 |
| e-2 | | 0.33 | 0.23 | 0.83 | 1.00 | 0.21 | — | 0.004 | 220 | 53 | 0 | 32 | 15 | 85 |
| e-3 | | 0.43 | 0.27 | 0.93 | 1.02 | 0.25 | — | 0.004 | 157 | 51 | 0 | 33 | 16 | 84 |
| e-4 | | 0.63 | 0.26 | 0.73 | 0.71 | 0.32 | — | 0.005 | 93 | 50 | 0 | 36 | 14 | 86 |

Table 15

| No. | Samples | Chemical Compositions (%) | | | | | Deoxidation Product (g/ton steel) | Composition of Deoxidation Product (%) | | | | $(SiO_2)+(MnO)+(Al_2O_3)$ |
|---|---|---|---|---|---|---|---|---|---|---|---|---|
| | | C | Si | Mn | Pb | Ca | | $SiO_2$ | MnO | $Al_2O_3$ | Others | |
| F-1 | Steel of this Invention | 0.17 | 0.16 | 1.23 | 0.07 | — | 338 | 57 | 22 | 6 | 15 | 85 |
| F-2 | | 0.30 | 0.30 | 1.75 | 0.04 | — | 227 | 47 | 16 | 25 | 12 | 88 |
| F-3 | | 0.48 | 0.34 | 1.87 | 0.06 | — | 120 | 54 | 10 | 25 | 11 | 89 |
| f-1 | Conventional Steels | 0.16 | 0.15 | 1.25 | — | 0.002 | 327 | 63 | 0 | 18 | 19 | 81 |
| f-2 | | 0.29 | 0.33 | 1.72 | — | 0.003 | 213 | 51 | 0 | 33 | 16 | 84 |
| f-3 | | 0.49 | 0.31 | 1.85 | — | 0.005 | 111 | 44 | 0 | 41 | 15 | 85 |

EXAMPLE 5

Manganese steel of the compositions given in Table 15 were prepared.

The tempered steel specimens were subjected to cutting test under the conditions indicated also in Table 8.

The high speed steel tool life observed is shown in Table 15.

Table 15

| No. | Samples | Tool Life of High Speed Steel Tool (min) |
|---|---|---|
| F-1 | Steel of this Invention | 157 |
| F-2 | | 85 |
| F-3 | | 35 |
| f-1 | Conventional | 92 |
| f-2 | | 42 |

EXAMPLE 6

Manganese-Chromium steels of the compositions given in Table 17 were prepared. The steel specimens were annealed and subjected to cutting test under the conditions indicated also in Table 8.

The high speed steel tool life obtained is shown in Table 18.

Table 18

| No. | Samples | Tool life of high speed steel tool (min) |
|---|---|---|
| G-1 | Steel of this Invention | 150 |
| G-2 | | 30 |
| g-1 | Conventional Steels | 65 |
| g-2 | | 11 |

Table 17

| No. | Samples | Chemical Compositions (%) | | | | | | Deoxidation Product (g/ton steel) | Composition of Deoxidation Products (%) | | | | $(SiO_2)+(MnO)+(Al_2O_3)$ (%) |
|---|---|---|---|---|---|---|---|---|---|---|---|---|---|
| | | C | Si | Mn | Cr | Pb | Ca | | $SiO_2$ | MnO | $Al_2O_3$ | Others | |
| G-1 | Steel of this In- | 0.18 | 0.28 | 1.23 | 0.35 | 0.05 | — | 253 | 54 | 21 | 10 | 15 | 85 |

Table 17-continued

| No. | Samples | Chemical Compositions (%) C | Si | Mn | Cr | Pb | Ca | Deoxidation Product (g/ton steel) | Composition of Deoxidation Products (%) $SiO_2$ | MnO | $Al_2O_3$ | Others | $(SiO_2)+(MnO)+(Al_2O_3)$ (%) |
|---|---|---|---|---|---|---|---|---|---|---|---|---|---|
| G-2 | vention | 0.46 | 0.20 | 1.60 | 0.65 | 0.04 | — | 123 | 50 | 13 | 23 | 14 | 86 |
| g-1 | Conventional Steels | 0.20 | 0.26 | 1.20 | 0.33 | — | 0.002 | 255 | 52 | 0 | 31 | 17 | 83 |
| g-2 | | 0.48 | 0.21 | 1.62 | 0.65 | — | 0.004 | 138 | 51 | 0 | 35 | 14 | 86 |

EXAMPLE 7

Molybdenum steels of the compositions given in Table 19 were prepared.

The annealed steel specimens were subjected to cutting test under the condition in Table 8.

The results are shown in Table 20.

Table 20

| No. | Samples | Tool Life of High Speed Steel Tool (min) |
|---|---|---|
| H-1 | Steel of this Invention | 520 |
| H-2 | | 350 |
| H-3 | | 95 |
| H-4 | | 40 |
| h-1 | Conventional Steels | 280 |
| h-2 | | 160 |
| h-3 | | 40 |
| h-4 | | 18 |

EXAMPLE 8

Nickel-Chromium steels of the compositions given in Table 21 were prepared.

The annealed steel specimens were subjected to cutting test under the conditions in Table 8.

The results are shown in Table 22.

Table 22

| No. | Samples | Tool Life of High Speed Steel Tools (min) |
|---|---|---|
| I-1 | Steel of this Invention | 81 |
| I-2 | | 24 |
| I-3 | | 30 |
| i-1 | Conventional Steels | 45 |
| i-2 | | 6 |
| i-3 | | 18 |

Table 21

| No. | Samples | Chemical Compositions (%) c | Si | Mn | Ni | Cr | Pb | Ca | Deoxidation Product (g/ton steel) | Composition of Deoxidation Product (%) $SiO_2$ | MnO | $Al_2O_3$ | Others | $(SiO_2)+(MnO)+(Al_2O_3)$ (%) |
|---|---|---|---|---|---|---|---|---|---|---|---|---|---|---|
| I-1 | Steel of this Invention | 0.12 | 0.33 | 0.50 | 2.35 | 0.25 | 0.05 | — | 440 | 53 | 27 | 5 | 15 | 85 |
| I-2 | | 0.33 | 0.25 | 0.50 | 3.42 | 0.95 | 0.08 | — | 218 | 55 | 20 | 14 | 11 | 89 |
| I-3 | | 0.38 | 0.17 | 0.80 | 1.10 | 0.80 | 0.04 | — | 142 | 55 | 11 | 24 | 10 | 90 |
| i-1 | Conventional Steels | 0.10 | 0.31 | 0.48 | 2.40 | 0.23 | — | 0.002 | 426 | 63 | 0 | 24 | 13 | 87 |
| i-2 | | 0.35 | 0.25 | 0.49 | 3.45 | 1.00 | — | 0.003 | 217 | 50 | 1 | 37 | 12 | 88 |
| i-3 | | 0.38 | 0.18 | 0.81 | 1.02 | 0.83 | — | 0.004 | 123 | 50 | 0 | 37 | 13 | 87 |

EXAMPLE 9

Nickel-Chromium-Molybdenum steels of the compositions indicated in Table 23 were prepared.

Table 19

| No. | Samples | Chemical Compositions (%) C | Si | Mn | Mo | Pb | Ca | Deoxidation Product (g/ton steel) | Composition of Deoxidation Product (%) $SiO_2$ | MnO | $Al_2O_3$ | Others | $(SiO_2)+(MnO)+(Al_2O_3)$ (%) |
|---|---|---|---|---|---|---|---|---|---|---|---|---|---|
| H-1 | Steel of this Invention | 0.09 | 0.25 | 0.97 | 0.20 | 0.04 | — | 439 | 57 | 23 | 5 | 15 | 85 |
| H-2 | | 0.18 | 0.33 | 0.47 | 0.55 | 0.05 | — | 373 | 53 | 20 | 14 | 13 | 87 |
| H-3 | | 0.35 | 0.21 | 0.81 | 0.21 | 0.08 | — | 225 | 47 | 16 | 23 | 14 | 86 |
| H-4 | | 0.50 | 0.28 | 0.94 | 0.25 | 0.04 | — | 153 | 54 | 11 | 24 | 11 | 89 |
| h-1 | Conventional Steels | 0.08 | 0.23 | 0.96 | 0.21 | — | 0.001 | 430 | 52 | 1 | 29 | 18 | 82 |
| h-2 | | 0.17 | 0.33 | 0.48 | 0.57 | — | 0.002 | 353 | 51 | 0 | 32 | 17 | 82 |
| h-3 | | 0.36 | 0.18 | 0.78 | 0.20 | — | 0.003 | 215 | 43 | 0 | 42 | 15 | 85 |
| h-4 | | 0.55 | 0.25 | 0.98 | 0.24 | — | 0.003 | 147 | 40 | 0 | 49 | 13 | 87 |

After annealing, the steel specimens were subjected to cutting test under the conditions given in Table 8. Table 24 shows the results of the test.

Table 24

| No. | Samples | Tool Life of High Speed Steel Tool (min) |
|---|---|---|
| J-1 | Steel of this Invention | 40 |
| J-2 | | 15 |
| J-3 | | 10 |
| J-4 | | 12 |
| J-5 | | 10 |
| J-6 | | 6 |
| j-1 | Conventional 3 Steels | 20 |
| j-2 | | 7 |
| j-3 | | |
| j-4 | | 4 |
| j-5 | | 5 |
| j-6 | | 2 |

Table 23

| No. | Samples | Chemical Compositions (%) C | Si | Mn | Ni | Cr | Mo | Pb | Ca | Deoxidation Product (g/ton steel) | Composition of Deoxidation Products (%) $SiO_2$ | MnO | $Al_2O_3$ | Others | $(SiO_2)+(MnO)+(Al_2O_3)$ (%) |
|---|---|---|---|---|---|---|---|---|---|---|---|---|---|---|---|
| J-1 | Steel of this Invention | 0.08 | 0.28 | 0.45 | 3.25 | 1.23 | 0.10 | 0.05 | — | 447 | 50 | 28 | 7 | 15 | 85 |
| J-2 | | 0.20 | 0.22 | 1.20 | 3.00 | 1.60 | 0.50 | 0.03 | — | 341 | 53 | 24 | 12 | 11 | 89 |
| J-3 | | 0.30 | 0.25 | 0.55 | 3.00 | 3.45 | 0.60 | 0.05 | — | 257 | 56 | 21 | 10 | 13 | 87 |
| J-4 | | 0.40 | 0.25 | 0.85 | 0.55 | 0.50 | 0.19 | 0.07 | — | 181 | 47 | 16 | 22 | 15 | 85 |
| J-5 | | 0.48 | 0.17 | 0.90 | 1.90 | 0.85 | 0.70 | 0.08 | — | 156 | 50 | 17 | 23 | 10 | 90 |
| J-6 | | 0.64 | 0.28 | 1.00 | 0.60 | 0.55 | 0.18 | 0.04 | — | 103 | 55 | 12 | 25 | 8 | 92 |
| j-1 | Conventional Steels | 0.09 | 0.30 | 0.44 | 3.23 | 1.25 | 0.10 | — | 0.001 | 453 | 49 | 0 | 44 | 7 | 93 |
| j-2 | | 0.22 | 0.20 | 1.18 | 2.95 | 1.55 | 0.15 | — | 0.002 | 306 | 49 | 1 | 44 | 6 | 94 |
| j-3 | | 0.31 | 0.25 | 0.53 | 3.02 | 3.40 | 0.60 | — | 0.002 | 221 | 51 | 0 | 38 | 11 | 89 |
| j-4 | | 0.42 | 0.25 | 0.80 | 0.60 | 0.52 | 0.17 | — | 0.003 | 200 | 48 | 0 | 42 | 10 | 90 |
| j-5 | | 0.50 | 0.17 | 0.91 | 1.80 | 0.88 | 0.75 | — | 0.003 | 161 | 40 | 0 | 54 | 6 | 94 |
| j-6 | | 0.65 | 0.29 | 1.05 | 0.62 | 0.51 | 0.20 | — | 0.003 | 81 | 43 | 0 | 50 | 7 | 93 |

In short, the distribution of Pb in conventional free cutting steels of the Ca-Pb type was not good; on the contrary the distribution of Pb in steel of this invention has been extremely improved by employing a specific deoxidizing agent which is effective for reduction of the melting point of the deoxidation product, adjusting the sum of contents of $SiO_2$, MnO and $Al_2O_3$ to at least 85% of the whole oxides of the deoxidation product, and thereafter adding Pb to the steel thereby to distribute Pb uniformly in the form of non-metallic inclusions composited with sulfides and finely divided Pb particles.

The free cutting steel of the present invention can exhibit a highly improved tool life when it is cut by a high speed steel tool. Thus, the free cutting steel of this invention has very excellent machinability.

We claim:

1. A free cutting steel for machine structural use having an excellent machinability for cutting with a high speed steel cutting tool, which consisting essentially of carbon 0.08 to 0.65%, silicon 0.10 to 0.35%, manganese 0.30 to 1.90%, nickel 0 to 4.50%, chromium 0 to 3.50%, molybdenum 0 to 0.70%, lead 0.02 to 0.10%, and the balance iron and inherent impurities, and further contains oxide inclusion within a range from 100 to 450 grams per ton of the steel, lead within the range of 0.02 to 0.10 percent by weight of the said oxide inclusion being uniformly dispersed composite inclusion consisting essentially of $SiO_2$ 40 to 60% by weight, MnO 10 to 30%, $Al_2O_3$ 5 to 25% and MO up to 15%, wherein MO is an oxide of a metal selected from the group consisting of calcium, magnesium and iron, and the sum of $SiO_2$, MnO and $Al_2O_3$ amounts to at least 85% of the oxide inclusion, and substantially all of the lead being uniformly distributed in the steel as finely divided particles in the form of composite inclusions comprising sulfides and finely divided lead particles.

2. A free cutting steel according to claim 1, wherein said steel for machine structural use is a plain carbon steel consisting of 0.08 to 0.60% of carbon, 0.10 to 0.30% of silicon, 0.30 to 1.65% of manganese and the remainder essentially iron and inherent impurities.

3. A free cutting steel according to claim 1, wherein the steel for machine structural use is a plain carbon steel comprising 0.08 to 0.61% carbon, 0.15 to 0.35% silicon, 0.30 to 0.90% manganese and the remainder essentially iron and inherent impurities.

4. A free cutting steel according to claim 1, wherein the steel for machine structural use is a plain carbon steel comprising 0.40 to 0.55% carbon, 0.15 to 0.35% silicon, 0.60 to 1.00% manganese and the remainder essentially iron and inherent impurities.

5. A free cutting steel according to claim 1, wherein the steel for machine structural uses is a chromium steel comprising 0.12 to 0.64% carbon, 0.20 to 0.35% silicon, 0.30 to 1.00% manganese, 0.30 to 1.15% chromium and the remainder essentially iron and inherent impurities.

6. A free cutting steel according to claim 1, wherein the steel for machine structural use is a chromium steel comprising 0.13 to 0.48% carbon, 0.15 to 0.35% silicon, 0.60 to 0.85% manganese, 0.90 to 1.20% chromium and the remainder essentially iron and inherent impurities.

7. A free cutting steel according to claim 1, wherein the steel for machine structural use is a chromium-molybdenum steel comprising 0.18 to 0.65% carbon, 0.15 to 0.35% silicon, 0.30 to 1.00% manganese, 0.70 to 1.20% chromium, 0.08 to 0.35% molybdenum and the remainder essentially iron and inherent impurities.

8. A free cutting steel according to claim 1, wherein the steel for machine structural use is a manganese steel comprising 0.17 to 0.48% carbon, 0.15 to 0.35% silicon, 1.20 to 1.90% manganese and the remainder essentially iron and inherent impurities.

9. A free cutting steel according to claim 1, wherein the steel for machine structural use is a molybdenum steel comprising 0.09 to 0.50% carbon, 0.20 to 0.35% silicon, 0.65 to 1.00% manganese, 0.15 to 0.60% molybdenum and the remainder essentially iron and inherent impurities.

10. A free cutting steel according to claim 1, wherein the steel for machine structural use is a manganese-chromium steel comprising 0.17 to 0.46% carbon, 0.15 to 0.35% silicon, 1.20 to 1.65% manganese, 0.35 to 0.70% chromium and the remainder essentially iron and inherent impurities.

11. A free cutting steel according to claim 1, wherein the steel for machine structural use is a chromium-molybdenun steel comprising 0.18 to 0.23% carbon, 0.15 to 0.35% silicon, 0.60 to 0.85% manganese, 0.90 to 1.20% chromium, 0.15 to 0.30% molybdenum and the remainder essentially iron and inherent impurities.

12. A free cutting steel according to claim 1, wherein the steel for machine structural use is a nickel-chromium steel comprising 0.12 to 0.40% carbon, 0.15 to 0.35% silicon, 0.35 to 0.80% manganese, 1.00 to 3.50% nickel, 0.20 to 1.00% chromium and the remainder essentially iron and inherent impurities.

13. A free cutting steel according to claim 1, wherein the steel for machine structural use is a nickel-chromium-molybdenum steel comprising 0.08 to 0.64% carbon, 0.20 to 0.35% silicon, 0.45 to 1.00% manganese, 0.40 to 3.50% nickel, 0.30 to 1.40% chromium, 0.08 to 0.40% molybdenum and the remainder essentially iron and inherent impurities.

14. A free cutting steel according to claim 1, wherein the steel for machine structural use is a nickel-chromium-molybdenum steel comprising 0.12 to 0.50% carbon, 0.15 to 0.35% silicon, 0.35 to 1.20% manganese, 0.40 to 4.50% nickel, 0.40 to 3.50% chromium, 0.15 to 0.70% molybdenum and the remainder essentially iron and inherent impurities.

* * * * *